US011913735B2

(12) United States Patent
Qi et al.

(10) Patent No.: US 11,913,735 B2
(45) Date of Patent: Feb. 27, 2024

(54) HEAT EXCHANGER

(71) Applicant: HANGZHOU SANHUA RESEARCH INSTITUTE CO., LTD., Zhejiang (CN)

(72) Inventors: Zhaogang Qi, Hangzhou (CN); Linjie Huang, East Amherst, NY (US); Qiang Gao, Hangzhou (CN); Jianlong Jiang, Hangzhou (CN); Yujiao Niu, Hangzhou (CN); Chunyu Shao, Hangzhou (CN)

(73) Assignee: HANGZHOU SANHUA RESEARCH INSTITUTE CO., LTD., Hangzhou (CN)

( * ) Notice: Subject to any disclaimer, the term of this patent is extended or adjusted under 35 U.S.C. 154(b) by 340 days.

(21) Appl. No.: 17/330,362

(22) Filed: May 25, 2021

(65) Prior Publication Data

US 2021/0285733 A1 Sep. 16, 2021

Related U.S. Application Data

(63) Continuation of application No. PCT/CN2019/109034, filed on Sep. 29, 2019.

(30) Foreign Application Priority Data

Sep. 30, 2018 (CN) ..... 201811155079.X

(51) Int. Cl.

| | |
|---|---|
| ***F28F 9/02*** | (2006.01) |
| ***F25B 39/00*** | (2006.01) |
| ***F28F 1/02*** | (2006.01) |

(52) U.S. Cl.
CPC ..... *F28F 9/0273* (2013.01); *F25B 39/00* (2013.01); *F28F 1/02* (2013.01)

(58) Field of Classification Search
CPC ..... F28F 9/0273; F28F 9/027; F28F 9/0265; F28F 9/026; F28F 9/0229; F28F 9/0224;
(Continued)

(56) References Cited

U.S. PATENT DOCUMENTS 1,684,083 A * 9/1928 Bloom ..... F28F 9/0273 165/174
5,327,959 A * 7/1994 Saperstein ..... F28D 1/05391 165/173

(Continued)

FOREIGN PATENT DOCUMENTS

CA 2596365 A1 8/2006
CN 201555396 U 8/2010

(Continued)

*Primary Examiner* — Frantz F Jules
*Assistant Examiner* — Jason N Thompson
(74) *Attorney, Agent, or Firm* — Cheng-Ju Chiang

(57) ABSTRACT

A heat exchanger includes a collecting pipe, a number of heat exchange tubes and a distribution pipe. A pipe wall of the distribution pipe defines a number of through holes communicating with the collecting pipe. The through holes are a first through hole, . . . an $(n-1)^{th}$ through hole and an $n^{th}$ through hole disposed in sequence along a direction from a first end to a second end of the distribution pipe. A distance between an $(i+1)^{th}$ through hole and an $i^{th}$ through hole is: $d_i=\alpha^i L_0$, i=1, 2, . . . n−1, $\alpha=0.618$, $L_0$ is a distance between adjacent heat exchange tubes. As a result, uniformity of refrigerant distribution in the heat exchanger is improved.

20 Claims, 6 Drawing Sheets

(58) Field of Classification Search
CPC ... F28F 9/0219; F28F 2265/26; F25B 39/029; F22B 37/228
See application file for complete search history.

(56) References Cited

U.S. PATENT DOCUMENTS

| | | | | |
|---|---|---|---|---|
| 2003/0006028 | A1* | 1/2003 | Kalbacher | F28F 21/067 165/173 |
| 2004/0026072 | A1* | 2/2004 | Yi | F28D 1/0341 165/175 |
| 2008/0289806 | A1* | 11/2008 | Gorbounov | F28D 1/05383 165/173 |
| 2011/0017438 | A1* | 1/2011 | Huazhao | F28D 1/05316 165/173 |
| 2013/0192808 | A1* | 8/2013 | Liu | F28F 9/0268 165/174 |
| 2015/0345843 | A1 | 12/2015 | Voorhis et al. | |
| 2017/0227264 | A1* | 8/2017 | Pautler | F28F 9/0268 |

FOREIGN PATENT DOCUMENTS

| | | | | |
|---|---|---|---|---|
| CN | 101839590 | A | 9/2010 | |
| CN | 102287969 | A | 12/2011 | |
| CN | 202216453 | U | 5/2012 | |
| CN | 202547196 | U | 11/2012 | |
| CN | 103206885 | A | 7/2013 | |
| CN | 203132410 | U | 8/2013 | |
| CN | 103673404 | A | 3/2014 | |
| CN | 103743158 | A | 4/2014 | |
| CN | 103206885 | B | 6/2015 | |
| CN | 104880115 | A | 9/2015 | |
| CN | 105074377 | A | 11/2015 | |
| CN | 107166811 | A | 9/2017 | |
| CN | 207180448 | U | 4/2018 | |
| FR | 3059397 | A1 * | 6/2018 | F25B 39/028 |
| JP | 6-159983 | A | 6/1994 | |
| JP | 2012-2475 | A | 1/2012 | |
| WO | WO-2017057184 | A1 * | 4/2017 | F28D 1/05383 |
| WO | 2018/154650 | A1 | 8/2018 | |
| WO | 2020/063962 | A1 | 4/2020 | |

* cited by examiner

HEAT EXCHANGER

CROSS-REFERENCE TO RELATED APPLICATIONS

This patent application is a bypass continuation of National Phase conversion of International (PCT) Patent Application No. PCT/CN2019/109034, filed on Sep. 29, 2019, which further claims priority of a Chinese Patent Application No. 201811155079.X, filed on Sep. 30, 2018 and titled "HEAT EXCHANGER", the entire content of which is incorporated herein by reference.

TECHNICAL FIELD

The present disclosure relates to a technical field of exchanging heat, in particular to a heat exchanger.

BACKGROUND

In related art, uniformity of refrigerant distribution in heat exchangers needs to be improved.

SUMMARY

For this reason, the present disclosure proposes a heat exchanger which is capable of improving uniformity of refrigerant distribution in the heat exchanger.

The heat exchanger according to the embodiment of a first aspect of the present disclosure includes: a collecting pipe having a first end, a second end, a pipe wall and an inner cavity; a plurality of heat exchange tubes arranged along a length direction of the collecting pipe, each of the heat exchange tubes having a first end and an inner channel, the inner channel of the heat exchange tube being in communication with the inner cavity of the collecting pipe; a distribution pipe having a first end, a second end, a pipe wall and an inner space, the first end of the distribution pipe being a fluid inlet, the second end of the distribution pipe being closed, the pipe wall of the distribution pipe comprising a plurality of through holes which are in communication with the inner cavity of the collecting pipe and the inner space of the distribution pipe, the plurality of through holes being disposed along a length direction of the distribution pipe, and the plurality of through holes comprising a first through hole, a second through hole, a third through hole, . . . an $(n-1)^{th}$ through hole and an $n^{th}$ through hole in sequence along a direction from the first end of the distribution pipe to the second end of the distribution pipe, wherein a distance between an $(i+1)^{th}$ through hole and an $i^{th}$ through hole is:

$d_i=\alpha^i L_0$, i=1, 2, . . . n−1, $\alpha=0.618$, $L_0$ is a distance between adjacent heat exchange tubes.

According to the heat exchanger of the embodiment of the present disclosure, by providing the distribution pipe of the above-mentioned form, the refrigerant in the inner cavity of the collecting pipe can be evenly distributed to the plurality of heat exchange tubes, thereby improving the uniformity of refrigerant distribution in the heat exchanger.

The heat exchanger according to the embodiment of a second aspect of the present disclosure includes: a collecting pipe having a first end, a second end, a pipe wall and an inner cavity; a plurality of heat exchange tubes disposed along a length direction of the collecting pipe, each of the heat exchange tubes having a first end and an inner channel, the inner channel of the heat exchange tube being in communication with the inner cavity of the collecting pipe; a distribution pipe having a first end, a second end, a pipe wall and an inner space, the first end of the distribution pipe being a fluid inlet, the second end of the distribution pipe being closed, the pipe wall of the distribution pipe defining a plurality of through holes which are in communication with the inner cavity of the collecting pipe and the inner space of the distribution pipe, one part of the through holes being located between the first end of the collecting pipe and a middle position of the collecting pipe in the length direction, the other part of the through holes being disposed along the length direction of the collecting pipe, distances between adjacent through holes being equal, the other part of the through holes being located between the middle position of the collecting pipe in the length direction and the second end of the collecting pipe, and the other part of the through holes comprising a first through hole, a second through hole, a third through hole, . . . , an $(n-1)^{th}$ through hole and an $n^{th}$ through hole in sequence in a direction from the middle position of the collecting pipe along the length direction toward the second end of the collecting pipe, wherein a distance between an $(i+1)^{th}$ through hole and an $i^{th}$ through hole is:

$d_i=\lambda\alpha^i L_0$, i=1, 2, . . . n−1, $\alpha=0.618$, $L_0$ is a distance between adjacent heat exchange tubes, and $\lambda$ is a coefficient.

Figure 1:
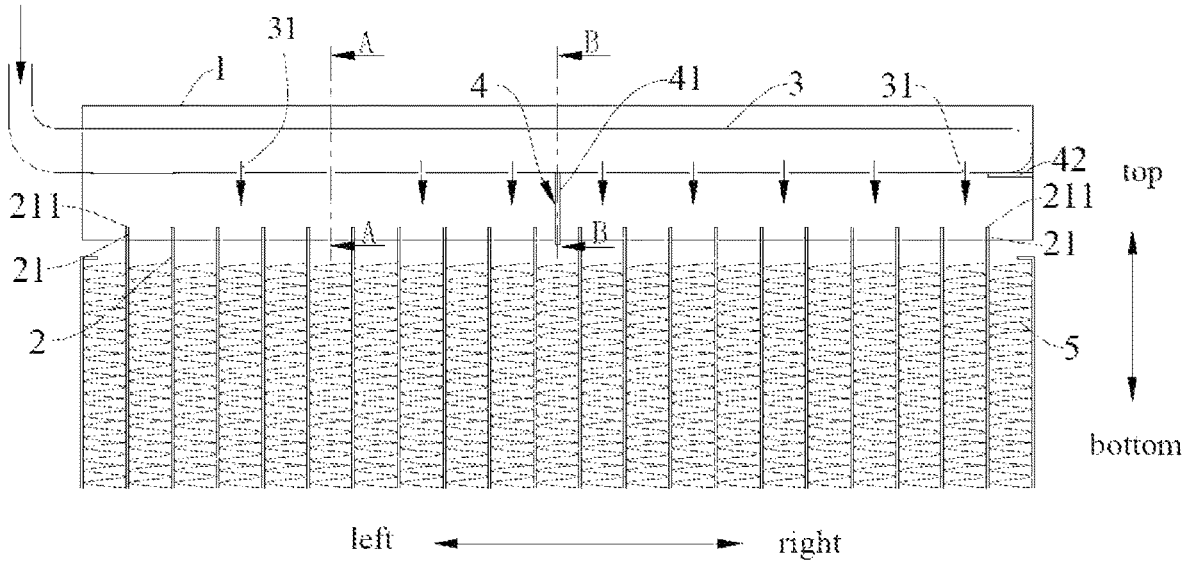
FIG. 1 is a schematic view of a heat exchanger in accordance with an embodiment of the present disclosure.

REFERENCE SIGNS collecting pipe 1, arc-shaped wall 11, bottom wall 12, first cavity 101, second cavity 102, heat exchange tube 2, first end of the heat exchange tube 21, end surface of the first end of the heat exchange tube 211, distribution pipe 3, through hole 31, support assembly 4, first support 41, second support 42, fin 5, baffle 6, slot 61.

DETAILED DESCRIPTION

Embodiments of the present disclosure are described in detail below, and examples of the embodiments are shown in drawings. The embodiments described below with reference to the drawings are exemplary, and are intended to explain the present disclosure, but should not be understood as a limitation to the present disclosure. The exemplary embodiments will be described in detail here, and examples thereof are shown in the drawings. When the following description refers to the drawings, unless otherwise indicated, the same numbers in different drawings indicate the same or similar elements. The implementation embodiments described in the following exemplary embodiments do not represent all implementation embodiments consistent with the present disclosure. On the contrary, they are merely examples of devices and methods consistent with some aspects of the present disclosure as detailed in the appended claims.

The terms used in the present disclosure are only for the purpose of describing specific embodiments, and are not intended to limit the present disclosure. In the description of the present disclosure, it should be understood that the terms "center", "longitudinal", "transverse", "length", "width", "thickness", "upper", "lower", "front", ""rear", "left", "right", "vertical", "horizontal", "top", "bottom", "inner", "outer", "clockwise", "counterclockwise" and other directions or positional relationships are based on the positions or positional relationships shown in the drawings, and are only for the convenience of" describing the disclosure and simplifying the description. It does not indicate or imply that the pointed devices or elements must have specific orientations, be constructed and operated in specific orientations, thereby it cannot be understood as a limitation of the present disclosure. In addition, the terms "first" and "second" are only used for descriptive purposes, and cannot be understood as indicating or implying relative importance or implicitly indicating the number of indicated technical features. Thus, the features defined with "first" and "second" may explicitly or implicitly include one or more of these features. In the description of the present disclosure, "a plurality of" means two or more than two, unless otherwise specifically defined.

In the description of the present disclosure, it should be noted that, unless otherwise clearly specified and limited, the terms "installation", "connected" and "connection" should be understood in a broad meaning. For example, it can be a fixed connection, a detachable connection or an integral connection; it can be a mechanical connection or an electrical connection; it can be directly connected or indirectly connected through an intermediate medium, including the connection between two internal elements or the interaction between two elements. For those of ordinary skill in the art, the specific meanings of the above-mentioned terms in the present disclosure can be understood according to specific circumstances.

In the present disclosure, unless otherwise clearly defined and limited, a first feature located "upper" or "lower" of a second feature may include the first feature and the second feature are in direct contact with each other, or may include the first feature and the second feature are in direct contact but through other features therebetween. Moreover, the first feature located "above", "over" or "on top of" the second feature includes the first feature is directly above and obliquely above the second feature, or it simply means that the level of the first feature is higher than that of the second feature. The first feature located "below", "under" and "at bottom of" the second feature includes the first feature is directly below and obliquely below the second feature, or it simply means that the level of the first feature is lower than the second feature. The exemplary embodiments of the present disclosure will be described in detail below with reference to the drawings. In the case of no conflict, the following embodiments and features in the embodiments can be mutually supplemented or combined with each other.

The terms used in the present disclosure are only for the purpose of describing specific embodiments, and are not intended to limit the present disclosure. The singular forms of "a", "said" and "the" described in the present disclosure and appended claims are also intended to include plural forms, unless the context clearly indicates otherwise.

The exemplary embodiments of the present disclosure will be described in detail below with reference to the drawings. In the case of no conflict, the following embodiments and features in the embodiments can be combined with each other.

As shown in FIGS. 1 to 9, a heat exchanger according to an embodiment of the present disclosure includes a collecting pipe/manifold 1, a heat exchange tube 2 and a distribution pipe 3. The collecting pipe 1 has a pipe wall and an inner cavity. A cross section of the collecting pipe 1 is circular, which means the collecting pipe 1 is a round pipe. The collecting pipe 1 has a first end (a left end of the collecting pipe 1 shown in FIG. 1) and a second end (a right end of the collecting pipe 1 shown in FIG. 1).

A plurality of the heat exchange tubes 2 are provided. The plurality of the heat exchange tubes 2 are spaced apart from each other along the length direction (a left-to-right direction shown in FIG. 1) of the collecting pipe 1. Optionally, the plurality of the heat exchange tubes 2 are disposed at even intervals along the length direction of the collecting pipe 1. That is distances between adjacent heat exchange tubes 2 are equal. Each heat exchange tube 2 has a first end 21 and an inner channel/micro-channels. The first end 21 of the heat exchange tube 2 passes through the pipe wall of the collecting pipe 1, the first cavity 101 and the baffle 6 in sequence, and is then inserted into the inner cavity of the collecting pipe 1. The inner channel of the heat exchange tube 2 is in communication with the inner cavity of the collecting pipe 1. In the description of the present disclosure, "a plurality of" means at least two, such as two, three, etc., unless otherwise specifically defined.

Specifically, the pipe wall of the collecting pipe 1 includes a plurality of insertion holes extending through the pipe wall of the collecting pipe 1. The plurality of insertion holes are spaced apart from each other along the length direction (the left-to-right direction shown in FIG. 1) of the collecting pipe 1. One heat exchange tube 2 corresponds to one insertion hole. The first end of the heat exchange tube 2 is inserted into the inner cavity of the collecting pipe 1 through the insertion hole. More specifically, the collecting pipe 1 is placed horizontally and has a length greater than 250 mm. The heat exchange tube 2 is placed vertically. A diameter of the collecting pipe 1 (that is a width of a bottom wall 12) is greater than a width of the heat exchange tube 2 so that the first end of the heat exchange tube 2 can be completely inserted into the inner cavity of the collecting pipe 1 in a width direction. Here, it should be understood that the width of the heat exchange tube 2 is a length of the heat exchange tube 2 in the left-to-right direction shown in FIG. 2.

The distribution pipe 3 has a first end (a left end of the distribution pipe 3 shown in FIG. 1) and a second end (a right end of the distribution pipe 3 shown in FIG. 1). The first end of the distribution pipe 3 is a fluid inlet so as to facilitate the flow of refrigerant into the distribution pipe 3. The second end of the distribution pipe 3 is closed and extends into the inner cavity of the collecting pipe 1 from the first end of the collecting pipe 1. It can be understood that, in order to distribute the refrigerant smoothly, the distribution pipe 3 is located above the heat exchange tube 2. Optionally, the distribution pipe 3 is spaced apart from the first end 21 of the heat exchange tube 2 by a certain distance. In other embodiments, the distribution pipe 3 is at least partially in contact with the first end of the heat exchange tube 2.

Figure 4:
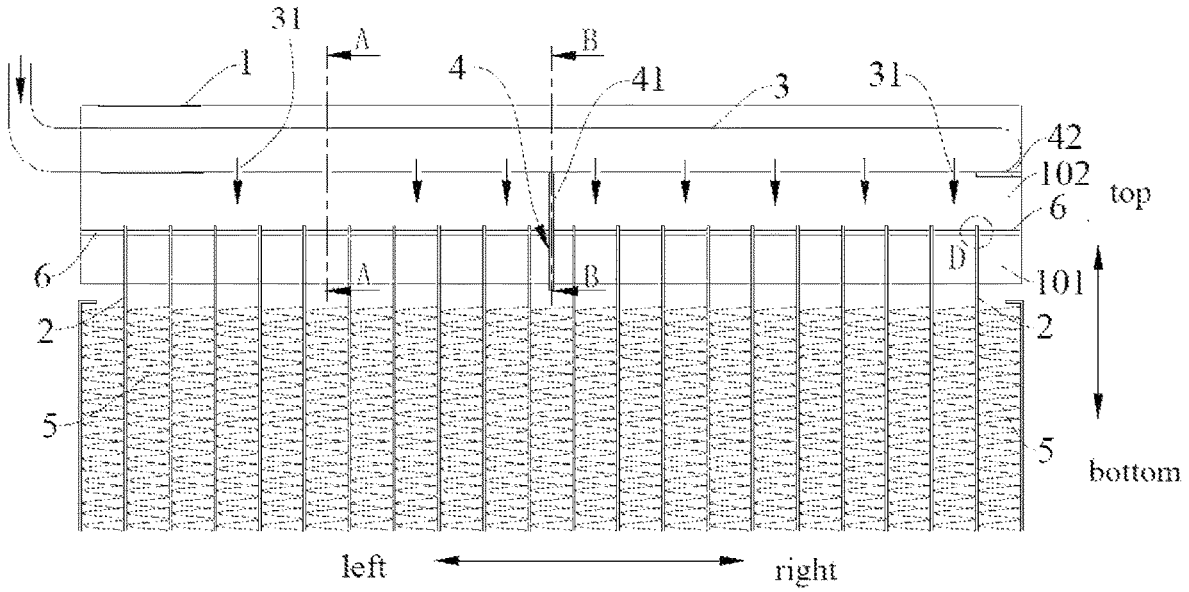
FIG. 4 is a schematic view of the heat exchanger in accordance with another embodiment of the present disclosure.
Figure 7:
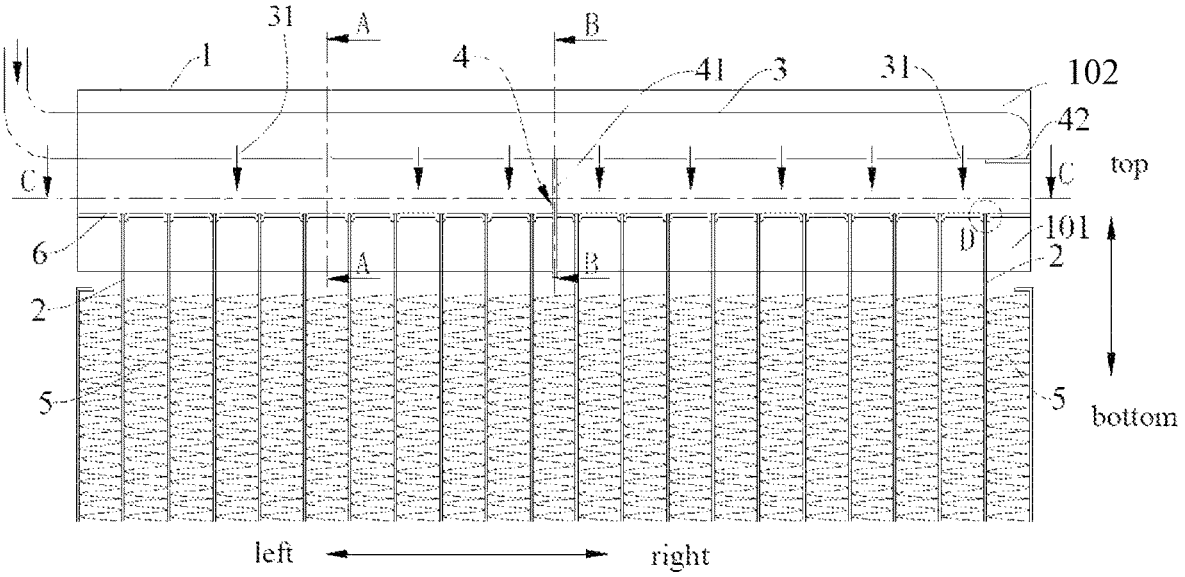
FIG. 7 is a schematic view of the heat exchanger in accordance with another embodiment of the present disclosure.

The distribution pipe 3 includes a pipe wall and an inner space. The pipe wall of the distribution pipe 3 has a through hole 31 in communication with the inner cavity of the collecting pipe 1 and the inner space of the distribution pipe 3. In other words, as shown in FIGS. 1, 4 and 7, a left end of the distribution pipe 3 is on a left side of the collecting pipe 1. A right end of the distribution pipe 3 extends into the inner cavity of the collecting pipe 1 from the left end of the collecting pipe 1. The right end of the distribution pipe 3 is closed. The through hole 31 extends through the pipe wall of the distribution pipe 3 along a wall thickness direction of the pipe wall. The through hole 31 is in communication with the inner space of the distribution pipe 3 and the inner cavity of the collecting pipe 1. The distribution pipe 3 is higher than the first end 21 of the heat exchange tube 2 in a top-to-bottom direction. It can be understood that the refrigerant flowing into the distribution pipe 3 through the first end of the distribution pipe 3, then flows to the second end of the distribution pipe 3. The refrigerant in the distribution pipe 3 flows into the inner cavity of the collecting pipe 1 through the through hole 31.

A plurality of through holes 31 are provided and are disposed at intervals along the length direction of the distribution pipe 3 (the left-to-right direction shown in FIG. 1). It can be understood that by providing the plurality of through holes 31 spaced apart from each other along the length of the distribution pipe 3 on the pipe wall of the distribution pipe 3, the refrigerant in the distribution pipe 3 can evenly flow into the inner cavity of the collecting pipe 1.

Among which, in some alternative embodiments, the plurality of through holes 31 include a first through hole, a second through hole, a third through hole, . . . an $(n-1)^{th}$ through hole and an $n^{th}$ through hole in sequence from the first end of the distribution pipe 3 toward the second end of the distribution pipe 3 (a left-to-right direction as shown in FIG. 1), wherein a distance between an $(i+1)^{th}$ through hole and an $i^{th}$ through hole is:

$d_i=\alpha^i L_0$, i=1, 2, . . . n−1, $\alpha=0.618$, $L_0$ is a distance between adjacent heat exchange tubes 2.

For example, a distance between the second through hole and the first through hole is: $d_1=\alpha^1 L_0$, and a distance between the third through hole and the second through hole is: $d_2=\alpha^2 L_0$. Here, it should be understood that the first through hole is the through hole 31 of the distribution pipe 3 closest to the fluid inlet. As shown in FIG. 1, the first through hole is the leftmost through hole 31. Through this formula, a relatively regular design can be used to achieve more uniform flow distribution.

In some specific embodiments, the plurality of heat exchange tubes 2 include a first heat exchange tube, a second heat exchange tube, a third heat exchange tube, a fourth heat exchange tube etc., in sequence from the first end of the distribution pipe 3 toward the second end of the distribution pipe 3 (the left-to-right direction as shown in FIG. 1). The first through hole is located between the third heat exchange tube and the fourth heat exchange tube. Here, the first heat exchange tube is the heat exchange tube 2 closest to the fluid inlet. As shown in FIG. 1, the first heat exchange tube is the leftmost heat exchange tube 2. In other words, the through hole 31 closest to the fluid inlet is disposed between the third heat exchange tube and the fourth heat exchange tube.

In other optional embodiments, the plurality of through holes 31 on the pipe wall of the distribution pipe 3 include a part of the through holes and another part of the through holes. The part of the through holes are located between the first end of the collecting pipe 1 (the left end of the collecting pipe 1 shown in FIG. 1) and a middle position of the collecting pipe 1 along the length direction. The part of the through holes are disposed at even intervals along the length direction of the distribution pipe 3 (the left-to-right direction shown in FIG. 1). The another part of the through holes are located between the middle position of the collecting pipe 1 along the length direction and the second end of the collecting pipe 1 (the right end of the collecting pipe 1 shown in FIG. 1). The another part of the through holes include a first through hole, a second through hole, a third through hole, . . . an $(n-1)^{th}$ through hole and an $n^{th}$ through hole in sequence along a direction from the middle position of the collecting pipe 1 toward the second end of the collecting pipe 1. A distance between an $(i+1)^{th}$ through hole and an $i^{th}$ through hole is:

$d_i=\lambda\alpha^i L_0$, i=1, 2, . . . n−1, $\alpha=0.618$, $L_0$ is a distance between adjacent heat exchange tubes 2, $\lambda$ is a coefficient. Through this formula, a relatively regular design can be used to achieve more uniform flow distribution.

In some specific embodiments, a distance between adjacent through holes 31 in the part of the through holes is $d=\lambda L_0$.

Specifically, $\lambda$ is 2 to 10. Optionally, $\lambda$ is 2.5. Therefore, the distance between adjacent through holes 31 in the part of the through holes is $d=2.5L_0$, and the distance between the $(i+1)^{th}$ through hole and the $i^{th}$ through hole in the another part of the through holes is: $d_i=2.5\alpha^i L_0$.

Optionally, the through hole 31 is a round hole. In the another part of the through holes, if $d_i<D_0$, then $d_i=D_0+2$, $D_0$ is a diameter of the through hole 31. Specifically, 1 mm$<D_0<$3 mm. Here, it can be understood that the middle position of the collecting pipe 1 along the length direction is half of the length of the collecting pipe 1, for example a position B-B as shown in FIG. 1.

According to the heat exchanger of the embodiment of the present disclosure, by providing the distribution pipe 3 with one end as the fluid inlet and the other end closed and extending into the inner cavity of the collecting pipe 1, and by providing the plurality of through holes with the above-mentioned spacing distances on the pipe wall of the distribution pipe 3, the refrigerant in the inner cavity of the collecting pipe 1 can be evenly distributed to the plurality of heat exchange tubes 2. As a result, the uniformity of the refrigerant distribution in the heat exchanger can be improved and the heat exchange efficiency can be improved.

The heat exchange tube 2 may be a flat tube which is also known as a microchannel flat tube in the industry. The use of the flat tubes is beneficial to reduce weight and size of air conditioners. Among them, an inside of the flat tube usually includes a plurality of channels for the flow of refrigerant. Adjacent channels are separated from each other. The plurality of the channels are disposed in a row, which together affect a width of the flat tubes. The flat tube is flat as a whole, its length is greater than its width, and its width is greater than its thickness. A length direction of the flat tube is the direction of refrigerant flow determined by the channels in the flat tubes. The length direction of the flat tube can be straight, folded or curved. The flat tube mentioned here is not limited to these types and may be of other forms. For example, adjacent channels may not be completely separated. For another example, all the channels can be disposed in two rows, as long as the width thereof is still greater than the thickness thereof.

In some embodiments, as shown in FIGS. 1, 4 and 7, the heat exchanger further includes fins 5 disposed between adjacent heat exchange tubes 2. As a result, heat exchange is performed with the heat exchange tubes 2 through the fins 5, thereby improving the heat exchange efficiency. Specifically, the plurality of heat exchange tubes 2 are spaced apart from each other. The fins 5 are disposed in the gaps between the adjacent heat exchange tubes 2, and the fins 5 are at least partially connected to the heat exchange tubes 2.

In some embodiments, a length of the distribution pipe 3 in the inner cavity of the collecting pipe 1 is substantially the same as a length of the collecting pipe 1. Specifically, the second end of the distribution pipe 3 extends from the first end of the collecting pipe 1 into the inner cavity of the collecting pipe 1, and extends to the second end of the collecting pipe 1. As shown in FIGS. 1, 4 and 7, the right end of the distribution pipe 3 extends from the left end of the collecting pipe 1 into the inner cavity of the collecting pipe 1, extends to the right and extends to the right end of the collecting pipe 1.

Figure 2:
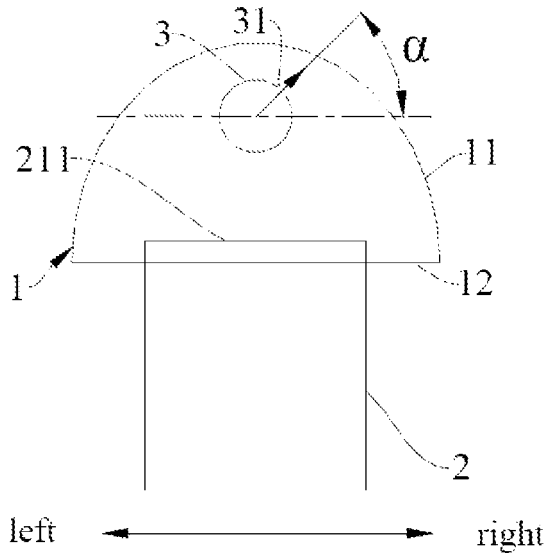
FIG. 2 is a schematic cross-sectional view taken along line A-A in FIG. 1 of the heat exchanger in accordance with the embodiment of the present disclosure.
Figure 6:
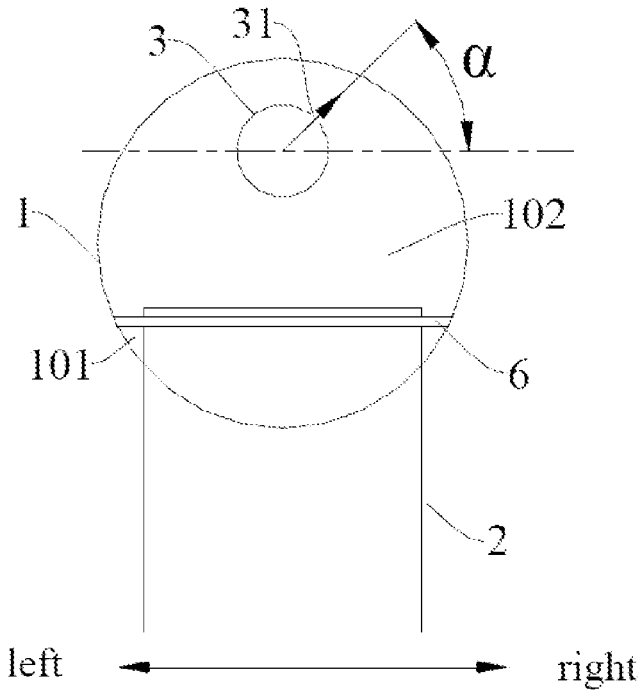
FIG. 6 is a schematic cross-sectional view taken along line A-A in FIG. 4 of the heat exchanger in accordance with the another embodiment of the present disclosure.
Figure 9:
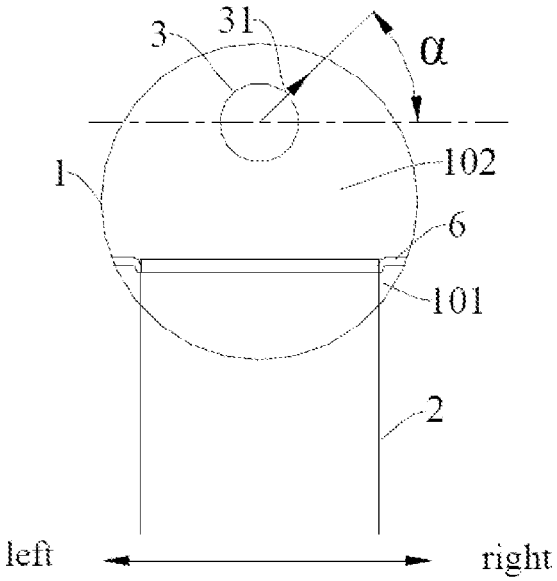
FIG. 9 is a schematic cross-sectional view taken along line A-A in FIG. 7 of the heat exchanger in accordance with the another embodiment of the present disclosure.

In some embodiments, as shown in FIGS. 2, 6 and 9, the through hole 31 may be opened at any position of the distribution pipe 3 along a circumference of the distribution pipe 3. That is, the through hole 31 may be opened at any position along a circumferential direction of the distribution pipe 3 for one rotation. In other words, as shown in FIG. 2, on a cross section of the distribution pipe 3 with the through hole 31, a straight line with a horizontal diameter of the distribution pipe 3 is defined a horizontal line. The through hole 31 may be located above the horizontal line, and an angle $\alpha$ between a connection line connecting a center of the through hole 31 and a center of the distribution pipe 3, and the horizontal line is $0°<\alpha<180°$. The through hole 31 may also be located below the horizontal line, and the angle $\alpha$ between the connection line connecting the center of the through hole 31 and the center of the distribution pipe 3, and the horizontal line is $0°<\alpha<180°$.

In some embodiments, as shown in FIGS. 1, 3, 4 and 7, the heat exchanger further includes a support assembly 4. The support assembly 4 includes a first support 41. The first support 41 has a first end (a lower end of the first support 41 shown in FIG. 3) and a second end (an upper end of the first support 41 shown in FIG. 3). The distribution pipe 3 has an outer peripheral surface. The first end of the first support 41 is connected to the collecting pipe 1. The second end of the first support 41 is located below the distribution pipe 3 and is in contact with the outer peripheral surface of the distribution pipe 3. Therefore, the distribution pipe 3 is supported by the first support 41. It can be understood that the arrangement form of the first support 41 is not limited to this. For example, in some alternative embodiments, the second end of the first support 41 may also be located below the distribution pipe 3 and connected to the distribution pipe 3. In other alternative embodiments, the first support 41 may be located above the distribution pipe 3. The upper end of the first support 41 is connected to the collecting pipe 1. The lower end of the first support 41 is connected to the distribution pipe 1.

Specifically, a plurality of the first supports 41 are provided. The plurality of first supports 41 are disposed at intervals from each other along the length direction of the collecting pipe 1 (the left-to-right direction shown in FIG. 1). Therefore, the distribution pipe 3 is jointly supported by the plurality of first supports 41. It can be understood that the present disclosure is not limited to this, and there may be only one first support 41 which is located at the middle position of the collecting pipe 1 along its length direction.

Figure 3:
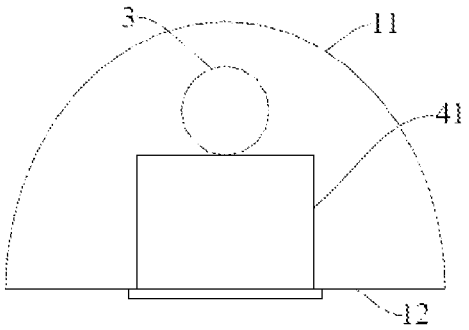
FIG. 3 is a schematic cross-sectional view taken along line B-B in FIG. 1 of the heat exchanger in accordance with the embodiment of the present disclosure.

In some specific embodiments, the first end of the first support 41 (the lower end of the first support 41 shown in FIG. 3) is connected to the outer peripheral surface of the collecting pipe 1. The second end of the first support 41 (the upper end of the first support 41 shown in FIG. 3) passes through the pipe wall of the collecting pipe 1 from the outer peripheral surface of the collecting pipe 1 and extends into the inner cavity of the collecting pipe 1. The second end of the first support 41 is in contact with the outer peripheral surface of the distribution pipe 3. Specifically, as shown in FIG. 3, the first support 41 includes a first section and a second section which are sequentially disposed along the top-to-bottom direction and connected to each other. The first section is in the inner cavity of the collecting pipe 1 and contacts the outer peripheral surface of the distribution pipe 3. The second section is attached to the outer peripheral surface of the collecting pipe 1.

In some embodiments, the support assembly 4 further includes a second support 42. The second support 42 extends into the inner cavity of the collecting pipe 1 from the second end of the collecting pipe 1 (the right end of the collecting pipe 1 shown in FIG. 1). The second support 42 is located below the distribution pipe 3 and is in contact with the outer peripheral surface of the distribution pipe 3. It can be understood that the arrangement form of the second support 42 is not limited to this. For example, in some alternative embodiments, the second support 42 is located below the distribution pipe and is connected to the outer peripheral surface of the distribution pipe 3. In other alternative embodiments, the second support 42 is located above the distribution pipe 3 and is connected to the outer peripheral surface of the distribution pipe 3. It is understandable that the present disclosure is not limited to this. For example, when the second end of the distribution pipe 3 is welded to the second end of the inner cavity of the collecting pipe 1, the support assembly 4 may not be provided with the second support 42. In the illustrated embodiment of the present disclosure, by providing the first support 41 and the second support 42 at the same time, the distribution pipe 3 can be better supported and positioned. It makes the distribution pipe 3 more fixed, and it is not easy to shift during the manufacturing and assembly processes.

In some embodiments, as shown in FIGS. 1 to 3, the pipe wall of the collecting pipe 1 includes an arc-shaped wall 11 and the bottom wall 12. The arc-shaped wall 11 has a first side edge and a second side edge. The bottom wall 12 has a first side edge and a second side edge. The first side edge of the arc-shaped wall 11 is connected to the first side edge of the bottom wall 12. The second side edge of the arc-shaped wall 12 is connected to the second side edge of the bottom wall 12. As a result, the arc-shaped wall 11 and the bottom wall 12 are connected, and the inner surface of the arc-shaped wall 11 and the inner surface of the bottom wall 12 are enclosed to form the inner cavity of the collecting pipe 1. The insertion holes are formed on the bottom wall 12. The first end 21 of the heat exchange tube 2 is inserted into the inner cavity of the collecting pipe 1 through the insertion hole on the bottom wall 12. A distance between the first end 21 of the heat exchange tube 2 and the bottom wall 12 is 0 mm to 2 mm. Here, it should be understood that the distance between the first end 21 of the heat exchange tube 2 and the bottom wall 12 is a vertical distance between the end surface 211 of the first end 21 of the heat exchange tube 2 and an inner surface of the bottom wall 12 surrounding the inner cavity of the collecting pipe 1. That is, a depth that the first end 21 of the heat exchange tube 2 extends into the collecting pipe 1 is 0 mm to 2 mm.

Optionally, the bottom wall 12 is generally straight, and the arc-shaped wall 11 is bent into an arc shape, so that a cross section of the collecting pipe 1 is generally D-shaped. Specifically, a cross section of the arc-shaped wall 11 is semicircular, so that the collecting pipe 1 is a semicircular pipe.

In other embodiments, as shown in FIGS. 4 to 9, the heat exchanger further includes a baffle 6. The baffle 6 is disposed in the inner cavity of the collecting pipe 1. The baffle 6 extends along the length direction of the collecting pipe 1 (the left-to-right direction shown in FIGS. 4 and 7) to divide the inner cavity of the collecting pipe 1 into a first cavity 101 and a second cavity 102. In other words, the inner cavity of the collecting pipe 1 includes the first cavity 101 and the second cavity 102 which both extend along the length direction of the collecting pipe 1. The baffle 6 includes a plurality of slots 61 extending through the baffle 6 along a thickness direction of the baffle 6. The plurality of slots 61 are disposed at intervals along a length direction of the baffle 6. The slots 61 are in communication with the first cavity 101 and the second cavity 102. The plurality of slots 61 and the plurality of insertion holes are disposed in a one-to-one correspondence manner. That is, one slot 61 is in alignment with one insertion hole.

Figure 5:
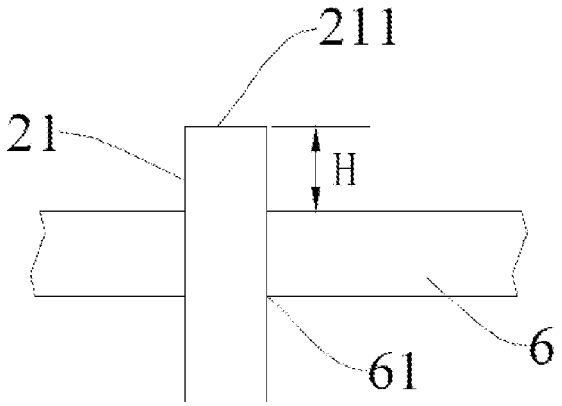
FIG. 5 is a partial enlarged schematic view at a portion D in FIG. 4 of the heat exchanger in accordance with the another embodiment of the present disclosure.

In some optional embodiments, as shown in FIGS. 4 to 6, the first end 21 of the heat exchange tube 2 passes through the pipe wall of the collecting pipe 1, the first cavity 101 and the baffle 6 in sequence, and is then inserted into the second cavity 102. The distance between the first end 21 of the heat exchange tube 2 and a surface of the baffle 6 adjacent to the second cavity 102 (an upper surface of the baffle 6 shown in FIG. 4) is 0 mm to 2 mm. The inner channel of the heat exchange tube 2 is in communication with the second cavity 102. Here, it should be understood that, the distance between the first end 21 of the heat exchange tube 2 and the baffle 6 is a vertical distance between the end face 211 of the first end 21 of the heat exchange tube 2 (an upper surface of the heat exchange tube 2 shown in FIG. 4) and the surface of the baffle 6 adjacent to the second cavity 102 (an upper surface of the baffle 6 shown in FIG. 4). That is, the depth that the first end of the heat exchange tube 2 extends into the second cavity 102 is 0 mm to 2 mm.

Figure 8:
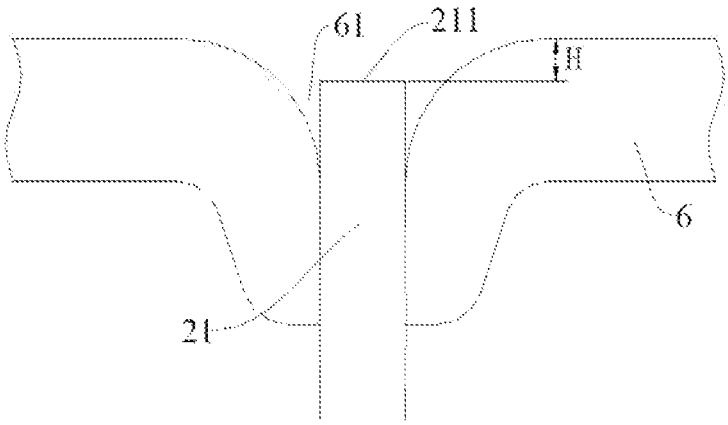
FIG. 8 is a partial enlarged schematic view at a portion D in FIG. 7 of the heat exchanger in accordance with the another embodiment of the present disclosure.

In other alternative embodiments, as shown in FIGS. 7 to 9, the first end 21 of the heat exchange tube 2 passes through the insertion hole and the first cavity 101 in sequence, and extends into the slot 61. The first end 21 of the heat exchange tube 2 does not extend beyond the slot 61, that is, the first end 21 of the heat exchange tube 2 is not inserted into the second cavity 102. The inner channel of the heat exchange tube 2 is in communication with the second cavity 102 through the slot 61. The distance between the first end 21 of the heat exchange tube 2 and the surface of the baffle 6 adjacent to the second cavity 102 (the upper surface of the baffle 6 shown in FIG. 7) is 0 mm to 2 mm. Here, it should be understood that the distance between the first end 21 of the heat exchange tube 2 and the surface of the baffle 6 adjacent to the second cavity 102 is a vertical distance between the end surface 211 of the first end 21 of the heat exchange tube 2 (the upper surface of the heat exchange tube 2 shown in FIG. 7) and the surface of the baffle 6 adjacent to the second cavity 102 (the upper surface of the baffle 6 shown in FIG. 7).

Specifically, flanging is performed by means of stamping at the slot 61 in a direction from the second cavity 102 toward the first cavity 101 (a top-to-bottom direction as shown in FIGS. 7 and 8), so that the slot 61 has a vertical side extending downwardly. The first end 21 of the heat exchange tube 2 sequentially passes through the insertion hole and the first cavity 101, and extends into the slot 61 at the vertical side formed by flanging.

Hereinafter, a heat exchanger according to a specific embodiment of the present disclosure will be described with reference to FIGS. 1 to 3.

As shown in FIGS. 1 to 3, the heat exchanger according to the embodiment of the present disclosure includes a collecting pipe 1, a plurality of heat exchange tubes 2, a distribution pipe 3, a support assembly 4, and fins 5. The collecting pipe 1 is placed horizontally. That is, the collecting pipe 1 extends in a left-to-right direction, and a length of the collecting pipe 1 is greater than 250 mm. A pipe wall of the collecting pipe 1 includes an arc-shaped wall 11 and a bottom wall 12 connected to each other. The bottom wall 12 is generally straight. The arc-shaped wall 11 is curved and has a semicircular cross section, so that the collecting pipe 1 is a semicircular pipe. The bottom wall 12 of the collecting pipe 1 has a plurality of insertion holes extending through the bottom wall 12 along a thickness direction of the bottom wall 12. The thickness direction is a vertical direction. The plurality of insertion holes are disposed at intervals along a length direction of the bottom wall 12. The length direction of the bottom wall 12 is the left-to-right direction shown in FIG. 1. Distances between adjacent insertion holes are equal.

The heat exchange tube 2 is a flat tube. There are a plurality of heat exchange tubes 2 which are disposed in sequence along the length direction of the collecting pipe 1 and are spaced apart from each other. Distances between adjacent heat exchange tubes 2 are equal. The first end 21 (the upper end shown in FIG. 1) of each heat exchange tube 2 passes through the insertion hole of the bottom wall 12 of the collecting pipe 1 along a bottom-to-top direction, and is inserted into the inner cavity of the collecting pipe 1. An inner channel of the heat exchange tube 2 is in communication with the inner cavity of the collecting pipe 1. One heat exchange tube 2 corresponds to one insertion hole. A distance between the end surface 211 of the first end 21 of the heat exchange tube 2 and an upper surface of the bottom wall 12 is 0 mm to 2 mm. That is, a depth that the first end 21 of the heat exchange tube 2 extends into the inner cavity of the collecting pipe 1 is 0 mm to 2 mm.

The fins 5 are disposed in gaps between the adjacent heat exchange tubes 2, and the fins 5 are at least partially connected with the heat exchange tubes 2 in order to improve the heat exchange efficiency.

A left end of the distribution pipe 3 is a fluid inlet so as to facilitate the flow of refrigerant into the distribution pipe 3. A right end of the distribution pipe 3 extends into the collecting pipe 1. The right end of the distribution pipe 3 extends to the right end of the collecting pipe 1, and the right end of the distribution pipe 3 is closed. The pipe wall of the distribution pipe 3 has a plurality of through holes 31 extending through the pipe wall of the distribution pipe 3. The through hole 31 is a round hole, and a diameter $D_0$ of the through hole 31 is 1 mm$<D_0<$3 mm. The inner space of the distribution pipe 3 and the inner cavity of the collecting pipe 2 are communicated through the through holes 31. That is, the refrigerant in the inner space of the distribution pipe 3 can enter the inner cavity of the collecting pipe 1 through the through holes 31 and further enter the heat exchange tubes 2. The outer peripheral surface of the distribution pipe 3 is spaced apart from the end surface of the first end of the heat exchange tube 2 in the top-to-bottom direction.

The through hole 31 may be opened at any position of the distribution pipe 3 along a circumference of the distribution pipe 3. In other words, the through hole 31 may be opened at any position along a circumferential direction of the distribution pipe 3 for one rotation.

The arrangement of the plurality of through holes 31 may be as follows: assuming that the plurality of through holes 31 include a first through hole, a second through hole, a third through hole, . . . an $(n-1)^{th}$ through hole and an $n^{th}$ through hole in sequence along a left-to-right direction. A distance between an $(i+1)^{th}$ through hole and an $i^{th}$ through hole is: $d_i=\alpha^i L_0$, i=1, 2, . . . n−1, $\alpha=0.618$, $L_0$ is a distance between adjacent heat exchange tubes 2. For example, a distance between the second through hole and the first through hole is: $d_1=\alpha^1 L_0$, and a distance between the third through hole and the second through hole is: $d_2=\alpha^2 L_0$.

Assuming that the plurality of heat exchange tubes 2 include a first heat exchange tube, a second heat exchange tube, a third heat exchange tube, a fourth heat exchange tube . . . in sequence along the left-to-right direction, and the first through hole is located between the third heat exchange tube and the fourth heat exchange tube.

The arrangement of the plurality of through holes 31 can also be as follows: the plurality of through holes 31 on the pipe wall of the distribution pipe 3 include a part of the through holes and another part of the through holes. Among them, the part of the through holes are located between the left end of the collecting pipe 1 and the middle position of the collecting pipe 1 along the length direction. The part of the through holes are disposed at even intervals along the length direction of the distribution pipe 3 (the left-to-right direction shown in FIG. 1). A distance between adjacent through holes 31 is $d=2.5L_0$, where $L_0$ is a distance between adjacent heat exchange tubes 2. Another part of the through holes are located between the middle position of the collecting pipe 1 in the length direction and the right end of the collecting pipe 1. The other part of the through holes include a first through hole, a second through hole, a third through hole, . . . an $(n-1)^{th}$ through hole and an $n^{th}$ through hole in sequence along a direction from the middle position of the collecting pipe 1 toward the second end of the collecting pipe 1. A distance between an $(i+1)^{th}$ through hole and an $i^{th}$ through hole is:

$d_i=2.5\alpha^i L_0$, i=1, 2, . . . n−1, $\alpha=0.618$, $\lambda$ is a coefficient; and if $d_i<D_0$, then $d_i=D_0+2$.

The support assembly 4 includes a first support 41 and a second support 42. A lower end of the first support 41 is connected to the bottom wall 11 of the collecting pipe 1. An upper end of the first support 41 extends from the bottom wall 11 of the collecting pipe 1 into the inner cavity of the collecting pipe 1. The upper end of the first support 41 is in contact with the outer peripheral surface of the distribution pipe 3. The first support 41 is located at the middle position of the collecting pipe 1 along the length direction to support the distribution pipe 3 at the middle position of the collecting pipe 1 along the length direction. The second support 42 extends into the collecting pipe 1 from the right end of the collecting pipe 1. The upper surface of the second support 42 is in contact with the outer peripheral surface of the distribution pipe 3 in order to support the distribution pipe 3 at the right end of the distribution pipe 3.

Hereinafter, the heat exchanger according to another specific embodiment of the present disclosure will be described with reference to FIGS. 4 to 6.

As shown in FIGS. 4 to 6, the heat exchanger according to an embodiment of the present disclosure includes a collecting pipe 1, a plurality of heat exchange tubes 2, a distribution pipe 3, a support assembly 4, fins 5 and a baffle 6. A cross section of the collecting pipe 1 is circular, that is, the collecting pipe 1 is a round pipe. The pipe wall of the collecting pipe 1 includes a plurality of insertion holes extending through the pipe wall of the collecting pipe 1 along a thickness direction of the pipe wall of the collecting pipe 1. The thickness direction of the pipe wall is a vertical direction. The plurality of insertion holes are disposed at intervals along the length direction of the collecting pipe 1. The length direction of the collecting pipe 1 is a left-to-right direction shown in FIG. 4. Distances between adjacent insertion holes are equal.

The baffle 6 is disposed in the inner cavity of the collecting pipe 1. The baffle 6 extends along the length direction of the collecting pipe 1 (the left-to-right direction shown in FIG. 4) to divide the inner cavity of the collecting pipe 1 into a first cavity 101 and a second cavity 102. The baffle 6 includes a plurality of slots 61 extending through the baffle 6 along a thickness direction of the baffle 6. The plurality of slots 61 are disposed at intervals along a length direction of the baffle 6. The plurality of slots 61 and the plurality of insertion holes are disposed in a one-to-one correspondence manner. That is, one slot 61 is in alignment with one insertion hole. The slot 61 is in communication with the first cavity 101 and the second cavity 102.

The heat exchange tube 2 is a flat tube. A plurality of heat exchange tubes 2 are provided and disposed at intervals along the length direction of the collecting pipe 1. Distances between adjacent heat exchange tubes 2 are equal. The first end 21 of each heat exchange tube 2 (the upper end of the heat exchange tube 2 shown in FIG. 1) is inserted into the second cavity 102 through the insertion hole, the first cavity 101 and the slot 61 in sequence along the bottom-to-top direction. The inner channel of the heat exchange tube 2 is in communication with the second cavity 102. One heat exchange tube 2 corresponds to one insertion hole. A distance between the end surface 211 of the first end 21 of the heat exchange tube 2 and an upper surface of the baffle 6 is 0 mm to 2 mm. That is, a depth that the first end 211 of the heat exchange tube 2 extends into the second cavity is 0 mm to 2 mm.

The fins 5 are disposed in gaps between the adjacent heat exchange tubes 2, and the fins 5 are at least partially connected with the heat exchange tubes 2 in order to improve the heat exchange efficiency.

A left end of the distribution pipe 3 is a fluid inlet. A right end of the distribution pipe 3 extends into the second cavity 102. The right end of the distribution pipe 3 extends to the right end of the collecting pipe 1, and the right end of the distribution pipe 3 is closed. The through holes 31 on the pipe wall of the distribution pipe 3 are in communication with the inner space of the distribution pipe 3 and the second cavity 102. That is, the refrigerant in the inner space of the distribution pipe 3 can enter the second cavity 102 through the through holes 31, and further enter the heat exchange tubes 2.

The support assembly 4 includes a first support 41 and a second support 42. A lower end of the first support 41 is connected to an outer peripheral surface of the collecting pipe 1. An upper end of the first support 41 extends from the outer peripheral surface of the collecting pipe 1 through the pipe wall of the collecting pipe 1, the first cavity 101 and the baffle 6 and then extends into the second cavity 102. The upper end of the first support 41 is in contact with the outer peripheral surface of the distribution pipe 3. The first support 41 is located at the first end 21 to support the distribution pipe 3. The second support 42 extends into the second cavity 102 from the right end of the collecting pipe 1. The upper surface of the second support 42 is in contact with the outer peripheral surface of the distribution pipe 3 in order to support the distribution pipe 3 at the right end of the distribution pipe 3.

Other features and operations of the heat exchanger shown in FIGS. 4 to 6 may be the same as the embodiment shown in FIGS. 1 to 3, which will not be described in detail here.

Hereinafter, the heat exchanger according to another specific embodiment of the present disclosure will be described with reference to FIGS. 7 to 9.

As shown in FIGS. 7 to 9, the heat exchanger according to the embodiment of the present disclosure includes a collecting pipe 1, a plurality of heat exchange tubes 2, a distribution pipe 3, a support assembly 4, fins 5 and a baffle 6.

Flanging is performed by means of stamping at the slot 61 of the baffle 6 in a direction (for example, a top-to-bottom direction as shown in FIGS. 7 and 8), so that the slot 61 has a vertical side extending downwardly. The first end 21 (the upper end of the heat exchange tube 2 shown in FIG. 7) of the heat exchange tube 2 sequentially passes through the insertion hole and the first cavity 101, and extends into the slot 61 at the vertical side formed by flanging. The first end 21 of the heat exchange tube 2 does not extend beyond the slot 61. That is, the first end 21 of the heat exchange tube 2 is not inserted into the second cavity 102. The inner channel of the heat exchange tube 2 is in communication with the second cavity 102 through the slots 61. A distance between the end surface 211 of the first end 21 of the heat exchange tube 2 and the upper surface of the baffle 6 is 0 mm to 2 mm.

Other features and operations of the heat exchanger shown in FIGS. 7 to 9 may be the same as the embodiment shown in FIGS. 4 to 6, which will not be described in detail here.

In the description of this specification, descriptions with reference to the terms "an embodiment", "some embodiments", "examples", "specific examples", or "some examples" etc., mean that the specific features, structures, materials, or characteristics described in conjunction with the embodiment or example are included in at least one embodiment or example of the present disclosure. In this specification, the schematic representations of the above terms do not necessarily refer to the same embodiment or example. Moreover, the described specific features, structures, materials or characteristics can be combined in any one or more embodiments or examples in a suitable manner. In addition, those skilled in the art can combine and combine the different embodiments or examples and the features of the different embodiments or examples described in this specification without contradicting each other.

Although the embodiments of the present disclosure have been shown and described above, it can be understood that the above embodiments are exemplary and should not be construed as limiting the present disclosure. Those of ordinary skill in the art can make changes, modifications, substitutions and varieties to the above-mentioned embodiments within the scope of the present disclosure.

What is claimed is:

1. A heat exchanger, comprising:

a collecting pipe having a first end, a second end, a pipe wall and an inner cavity;

a plurality of heat exchange tubes arranged along a length direction of the collecting pipe, each of the heat exchange tubes having a first end and an inner channel, the inner channel of the heat exchange tube being in communication with the inner cavity of the collecting pipe;

a distribution pipe having a first end, a second end, a pipe wall and an inner space, the first end of the distribution pipe being a fluid inlet, the second end of the distribution pipe being closed, the pipe wall of the distribution pipe defining a plurality of through holes which are in communication with the inner cavity of the collecting pipe and the inner space of the distribution pipe, the plurality of through holes being disposed along a length direction of the distribution pipe, and the plurality of through holes comprising a first through hole, a second through hole, a third through hole, . . . an $(n-1)^{th}$ through hole and an $n^{th}$ through hole in sequence along a direction from the first end of the distribution pipe to the second end of the distribution pipe, wherein a value of n is an integer greater than or equal to five, a distance between an $(i+1)^{th}$ through hole and an $i^{th}$ through hole is:

$d_i=\alpha^i L_0$, i=1, 2, . . . n−1, $\alpha=0.618$, $L_0$ is a distance between adjacent heat exchange tubes;

wherein the heat exchanger further comprises a support assembly comprising:

a first support having a first end and a second end, the collecting pipe having an outer peripheral surface, the distribution pipe having an outer peripheral surface, wherein the first end of the first support is connected to the outer peripheral surface of the collecting pipe and the second end of the first support is in contact with the outer peripheral surface of the distribution pipe such that, along a direction from the first end of the first support to the second end of the first support, the first support extends through the pipe wall of the collecting pipe and into the inner cavity of the collecting pipe; and a second support extending from the second end of the collecting pipe into the inner cavity of the collecting pipe, and the second support being in contact with the outer peripheral surface of the distribution pipe.

2. The heat exchanger according to claim 1, wherein the plurality of heat exchange tubes comprise a first heat exchange tube, a second heat exchange tube, a third heat exchange tube and a fourth heat exchange tube in sequence along the direction from the first end of the distribution pipe to the second end of the distribution pipe;

wherein the first through hole is located between the third heat exchange tube and the fourth heat exchange tube.

3. The heat exchanger according to claim 1, wherein the first end of the heat exchange tube extends through the pipe wall of the collecting pipe and is inserted into the inner cavity of the collecting pipe.

4. The heat exchanger according to claim 1, wherein the second end of the distribution pipe extends from the first end of the collecting pipe into the inner cavity of the collecting pipe.

5. The heat exchanger according to claim 1, wherein each through hole of the plurality of through holes is configured to be opened at any position of the distribution pipe along a circumferential direction of the distribution pipe.

6. The heat exchanger according to claim 1, wherein the pipe wall of the collecting pipe comprises an arc-shaped wall and a bottom wall, the arc-shaped wall has a first side edge and a second side edge, the bottom wall has a first side edge and a second side edge, the first side edge of the arc-shaped wall is connected to the first side edge of the bottom wall, and the second side edge of the arc-shaped wall is connected to the second side edge of the bottom wall.

7. The heat exchanger according to claim 6, wherein a cross section of the collecting pipe is substantially D-shaped, a cross section of the arc-shaped wall is semicircular, and a distance between the first end of the heat exchange tube and the bottom wall is 0 mm to 2 mm.

8. The heat exchanger according to claim 1, wherein the collecting pipe is a round pipe, the pipe wall of the collecting pipe defines a plurality of insertion holes which are disposed along the length direction of the collecting pipe; wherein the heat exchanger further comprises a baffle disposed in the inner cavity of the collecting pipe, the baffle extends along the length direction of the collecting pipe, the baffle divides the collecting pipe into a first cavity and a second cavity, the baffle defines a plurality of slots which are disposed along an extending direction of the baffle, the plurality of slots and the plurality of insertion holes are disposed in a one-to-one correspondence manner, and the slots extend through the baffle along a thickness direction of the baffle.

9. The heat exchanger according to claim 8, wherein the first end of each heat exchange tube is inserted into the second cavity through a corresponding insertion hole, the first cavity and a corresponding slot in sequence, the inner channel of each heat exchange tube is in communication with the second cavity, and a distance between the first end of each heat exchange tube and a surface of the baffle adjacent to the second cavity is 0 mm to 2 mm.

10. The heat exchanger according to claim 8, wherein the first end of each heat exchange tube sequentially extends through a corresponding insertion hole and the first cavity, and extends into a corresponding slot, the first end of each heat exchange tube does not protrude beyond the corresponding slot, the inner channel of each heat exchange tube is in communication with the second cavity through the corresponding slot, and a distance between the first end of each heat exchange tube and a surface of the flat tube each heat exchange tube adjacent to the second cavity is 0 mm to 2 mm.

11. A heat exchanger, comprising:

a collecting pipe having a first end, a second end, a pipe wall and an inner cavity; the pipe wall of the collecting pipe defining a plurality of insertion holes which are disposed along a length direction of the collecting pipe;

a baffle disposed in the inner cavity of the collecting pipe, the baffle extending along the length direction of the collecting pipe so as to separate the inner cavity of the collecting pipe into a first cavity and a second cavity; the baffle defining a plurality of slots which are disposed along an extending direction of the baffle, the plurality of slots and the plurality of insertion holes being disposed in a one-to-one correspondence manner, the plurality of slots extending through the baffle along a thickness direction of the baffle;

a plurality of heat exchange tubes disposed along the length direction of the collecting pipe, each of the heat exchange tubes having a first end and an inner channel, each heat exchange tube extending through a corresponding insertion hole and a corresponding slot so that the first end of each heat exchange tube is inserted into the second cavity, and at least part of each heat exchange tube is disposed in the first cavity; the inner channel of the heat exchange tube being in communication with the second cavity of the collecting pipe;

a distribution pipe partially disposed in the second cavity, the distribution pipe having a first end, a second end, a pipe wall and an inner space, the first cavity being separated from the distribution tube by the baffle along the thickness direction of the baffle, the first end of the distribution pipe being a fluid inlet, the second end of the distribution pipe being closed, the pipe wall of the distribution pipe defining a plurality of through holes which are in communication with the inner cavity of the collecting pipe and the inner space of the distribution pipe, one part of all of the through holes being located between the first end of the collecting pipe and a middle position of the collecting pipe in the length direction, the other part of all of the through holes being disposed along the length direction of the collecting pipe, distances between adjacent through holes being equal, the other part of all of the through holes being located between the middle position of the collecting pipe in the length direction and the second end of the collecting pipe, and the other part of all of the through holes comprising a first through hole, a second through hole, a third through hole, . . . , an $(n-1)^{th}$ through hole and an $n^{th}$ through hole in sequence in a direction from the middle position of the collecting pipe along the length direction toward the second end of the collecting pipe, wherein a value of n is an integer greater than or equal to five, a distance between an $(i+1)^{th}$ through hole and an $i^{th}$ through hole is:

$d_i=\lambda\alpha^i L_0$, i=1, 2, . . . n−1, $\alpha=0.618$, $L_0$ is a distance between adjacent heat exchange tubes, and $\lambda$ is a coefficient.

12. The heat exchanger according to claim 11, wherein in the one part of all of the through holes, the distance between every two adjacent through holes thereof is: $d=\lambda L_0$.

13. The heat exchanger according to claim 12, wherein $\lambda$ is 2 to 10.

14. The heat exchanger according to claim 13, wherein $\lambda$ is 2.5.

15. The heat exchanger according to claim 11, wherein each through hole of the plurality of through holes is a round hole, and a diameter $D_0$ of the through hole is 1 mm$<D_0<$3 mm.

16. The heat exchanger according to claim 15, wherein in the other part of all of the through holes, if $d_i<D_0$, then $d_i=D_0+2$.

17. The heat exchanger according to claim 11, wherein the first end of the heat exchange tube extends through the pipe wall of the collecting pipe and is inserted into the inner cavity of the collecting pipe.

18. The heat exchanger according to claim 11, wherein the second end of the distribution pipe extends from the first end of the collecting pipe into the inner cavity of the collecting pipe.

19. The heat exchanger according to claim 11, further comprising a support assembly, the support assembly comprising:

a first support having a first end and a second end, the collecting pipe having an outer peripheral surface, the distribution pipe having an outer peripheral surface, wherein the first end of the first support is connected to the outer peripheral surface of the collecting pipe and the second end of the first support is in contact with the outer peripheral surface of the distribution pipe such that, along a direction from the first end of the first support to the second end of the first support, the first support extends through the pipe wall of the collecting pipe and into the inner cavity of the collecting pipe; and a second support extending from the second end of the collecting pipe into the inner cavity of the collecting pipe, and the second support being in contact with the outer peripheral surface of the distribution pipe.

20. A heat exchanger, comprising:

a manifold extending along a transverse direction, the manifold defining an inner cavity; the manifold comprising a pipe wall defining a plurality of insertion holes which are disposed along the transverse direction;

a baffle disposed in the inner cavity of the manifold, the baffle extending along the transverse direction of the manifold so as to separate the inner cavity of the manifold into a first cavity and a second cavity, the baffle defining a plurality of slots which are disposed along an extending direction of the baffle, the plurality of slots and the plurality of insertion holes being disposed in a one-to-one correspondence manner, the plurality of slots extending through the baffle along a vertical direction perpendicular to the transverse direction;

a plurality of heat exchange tubes connecting with the manifold and extending along the vertical direction, the heat exchanger tubes arranged at intervals along the transverse direction, each heat exchange tube extending through a corresponding insertion hole and a corresponding slot so that a first end of each heat exchange tube is inserted into the second cavity, and at least part of each heat exchange tube is disposed in the first cavity; each heat exchange tube defining a row of micro-channels in communication with the second cavity of the manifold; and a distribution pipe comprising a first portion located in the second cavity of the manifold and a second portion located outside the manifold; the first cavity being separated from the distribution tube by the baffle along the vertical direction; the second portion of the distribution pipe defining a fluid inlet, the first portion defining a chamber being in communication with the fluid inlet; the first portion defining a plurality of through holes communicated with the second cavity and the chamber;

the plurality of through holes comprising a first through hole, a second through hole, a third through hole, . . . an $(n-1)^{th}$ through hole and an $n^{th}$ through hole in sequence along the transverse direction from an end of the first portion close to the second portion to an end of the first portion away from the second portion; wherein a value of n is an integer greater than or equal to five;

wherein an $(i+1)^{th}$ through hole and an $i^{th}$ through hole satisfy a relationship: $d_i=L_0$, $i=1, 2, \ldots n-1$, $\alpha=0.618$;

wherein $d_i$ represents a distance between the $(i+1)^{th}$ through hole and the $i^{th}$ through hole, and $L_0$ represents a distance between adjacent heat exchange tubes.

* * * * *